United States Patent [19]

Jackson

[11] 4,080,864

[45] Mar. 28, 1978

[54] PEDAL ACTUATED PITCH-CHANGING MEANS FOR A STRINGED INSTRUMENT

[76] Inventor: David H. Jackson, 178 2nd Ave. No., Nashville, Tenn. 37203

[21] Appl. No.: 685,517

[22] Filed: May 12, 1976

[51] Int. Cl.[2] ..... G10D 3/14

[52] U.S. Cl. ..... 84/312 P

[58] Field of Search ..... 84/312 R, 312 P

[56] References Cited

U.S. PATENT DOCUMENTS

| | | | |
|---|---|---|---|
| 2,973,682 | 3/1961 | Fender | 84/312 P |
| 3,352,188 | 11/1967 | Fender | 84/312 P |
| 3,390,600 | 7/1968 | Kelley | 84/312 P |
| 3,435,722 | 4/1969 | Paul et al. | 84/312 P |
| 3,688,631 | 9/1972 | Jackson | 84/312 P |

*Primary Examiner*—Lawrence R. Franklin

*Attorney, Agent, or Firm*—Melville, Strasser, Foster & Hoffman

[57] ABSTRACT

A pedal-actuated pitch-changing means for each string of a guitar or like stringed instrument. Each pitch changing means is capable of increasing and decreasing the pitch of its respective string from a predetermined tuned pitch. Each string is attached at the head end of the instrument to an ordinary tuning machine and at the tail end of the instrument to its respective pitch changing means. Each pitch-changing means comprises a pivotable string finger to which the tail end of its respective string is attached, a raising bar located adjacent the string finger and a lowering bar pivotally attached to the raising bar. The raising bar may have a pull rod operatively connected thereto for applying a pulling force to the raising bar to pivot the string finger to a pitch-increasing position. The lowering bar may have a pull rod operatively connected thereto for applying a pulling force to the lowering bar to pivot the string finger to a pitch-decreasing position. The stringed instrument has a plurality of pedals. Each pull rod associated with each string of the instrument may be operatively attached in an improved manner to any of the pedals so that each pedal may raise the pitch of certain selected strings and lower the pitch of other selected strings in any desired combination.

13 Claims, 16 Drawing Figures

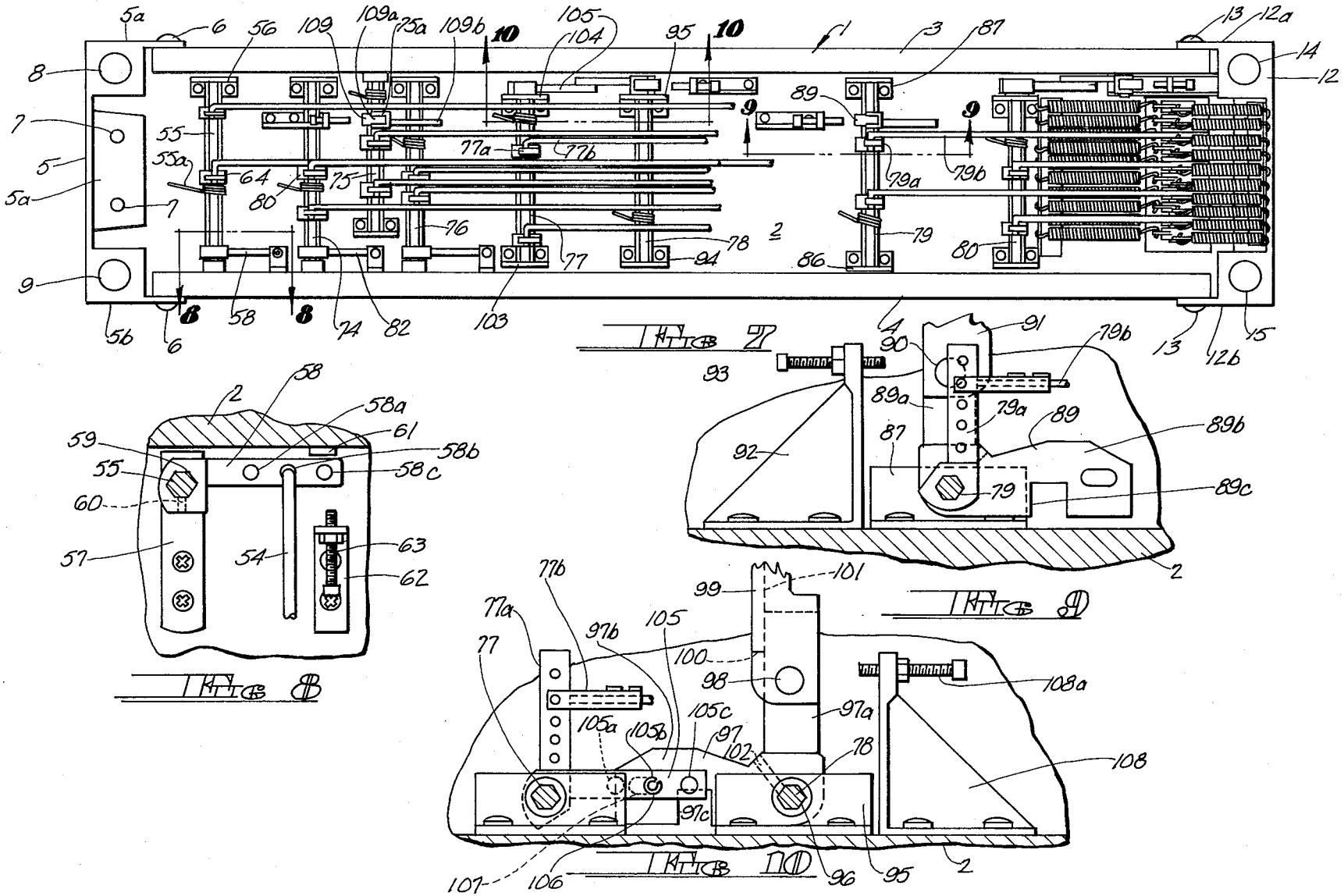

PEDAL ACTUATED PITCH-CHANGING MEANS FOR A STRINGED INSTRUMENT

BACKGROUND OF THE INVENTION

1. Field of the Invention

The invention relates to improved pedal actuated pitch-changing means for a string instrument, and more particularly to improved pedal actuated pitch-changing means for raising and lowering the pitch of individual strings from their normal or tuned pitch and to improved means for operatively connecting the pitch-changing means to the instrument pedals.

2. Description of the Prior Art

The pedal actuated pitch-changing means of the present invention may be applied to various types of stringed instruments. While not intended to be so limited, for purposes of an exemplary showing the pedal actuated pitch-changing means will be described in its application to a single neck electric steel guitar.

In recent years, stringed instruments having string tension or pitch adjusting means, have greatly increased in popularity. Prior art workers have devised a number of pedal actuated mechanisms for changing the pitch of individual strings. Typical examples of such prior art mechanisms are taught in U.S. Pat. No. 3,014,395, U.S. Pat. No. 2,973,682 and U.S. Pat. No. 3,688,631.

While prior art mechanisms have performed well, they have generally been complex in nature and expensive to manufacture. The tuning of such instruments has often been difficult, frequently involving the adjustment of various means at various locations on the instrument. Finally, where possible at all, changing the "set-up" of the instrument has been a complicated and time consuming operation.

The pitch-changing means of the present invention is characterized by a greater simplicity and versatility than hitherto known. Each string is provided with means whereby the pitch of the string may be raised only or both raised and lowered. Change-over between these two modes may be made simply and rapidly. The pitch-changing means can be more easily and inexpensively manufactured. The present invention also provides simplified means by which the pitch-changing means may be operatively connected to the instrument pedals. The "set-up" of the instrument may be easily and efficiently changed. Finally, the instrument is characterized by excellent tuning stability and pedal response.

SUMMARY OF THE INVENTION

The present invention relates to pedal actuated pitch-changing means for stringed instruments whereby the tension or pitch of each individual string may be raised or lowered, by a predetermined amount, from its normal or tuned pitch. The stringed instrument has an elongated body with a head end and a tail end. Each string of the instrument is attached at the head end of the instrument to a conventional tuning machine. At the tail end of the instrument, each string is attached to its own individual pitch-changing means. The pitch changing means for the various strings are substantially identical and each pitch changing means comprises a pivotally mounted string finger to which the tail end of its respective string is attached, an adjacent pivotally mounted raising bar and a lowering bar pivotally affixed to the raising bar.

In a first embodiment, the upper forward edge of the string finger is provided with a notch. A forward pivot plate is mounted transversely of the instrument with an edge of the forward pivot plate received in the notch in the string finger so that the string finger is pivotable about that forward pivot plate edge. In similar fashion, the upper rearward edge of the raising bar is provided with a notch adapted to receive an edge of a rearward pivot plate transversely mounted on the instrument so that the raising bar is pivotable about that edge of the rearward pivot plate.

In a second embodiment, the string finger of each pitch changing means is pivotally mounted on a shaft extending transversely of the instrument. In this second embodiment, the raising bar is, at its upper end, pivotally attached to the string finger and the lowering bar is pivoted to the raising bar.

In both embodiments, when a pulling force toward the head end of the instrument is applied to the lower end of the raising bar, the combined movement of the raising and lowering bars will shift the string finger to a pitch raising position. Similarly, when a pulling force toward the head end of the instrument is applied to the lower end of the lowering bar, the lowering bar will permit the shifting of the string finger to a pitch lowering position. Means are provided to adjust the pitch raising and lowering positions of the string finger, as will be described hereinafter.

A plurality of shafts are mounted on the underside of the instrument, extending transversely thereof. The shafts are preferrably of noncircular cross section. One or more pull rod cranks are mounted on each shaft. Each pull rod crank is provided with a hole shaped to receive the shaft and is adjustable in position along the length of the shaft. A plurality of pull rods are provided. Each pull rod is operatively attached at one end to a selected one of the raising or lowering bars of one of the pitch-changing means. Each pull rod is attached at its other end by novel spring clip means to a selected one of the pull rod cranks mounted on the transverse shafts.

Finally, each shaft is operatively connected to a foot or knee pedal by which the shaft may be rotated. Means are provided to adjust the amount by which each shaft is rotated by its pedal, as will be described hereinafter.

BRIEF DESCRIPTION OF THE DRAWINGS

FIG. 6 is a fragmentary longitudinal cross sectional view similar to FIGS. 4 and 5 and illustrating the pitch-changing means in its pitch-lowering position.

FIG. 7 is a bottom view of the stringed instrument of the present invention.

FIG. 9 is a fragmentary cross sectional view taken along section line 9—9 of FIG. 7.

FIG. 12 is a fragmentary elevational view, partly in cross section, similar to FIG. 11 and illustrating the pitch-changing means of FIG. 11 in its pitch-raising position.

DESCRIPTION OF THE PREFERRED EMBODIMENTS

Figure 2:
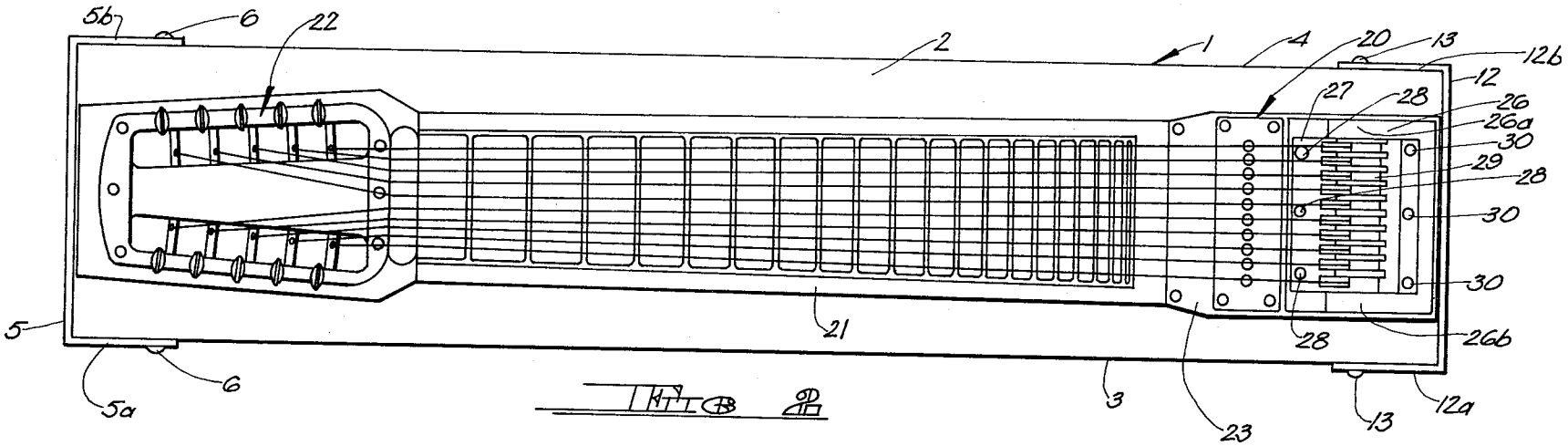
FIG. 2 is a plan view of the instrument of FIG. 1.
Figure 1:
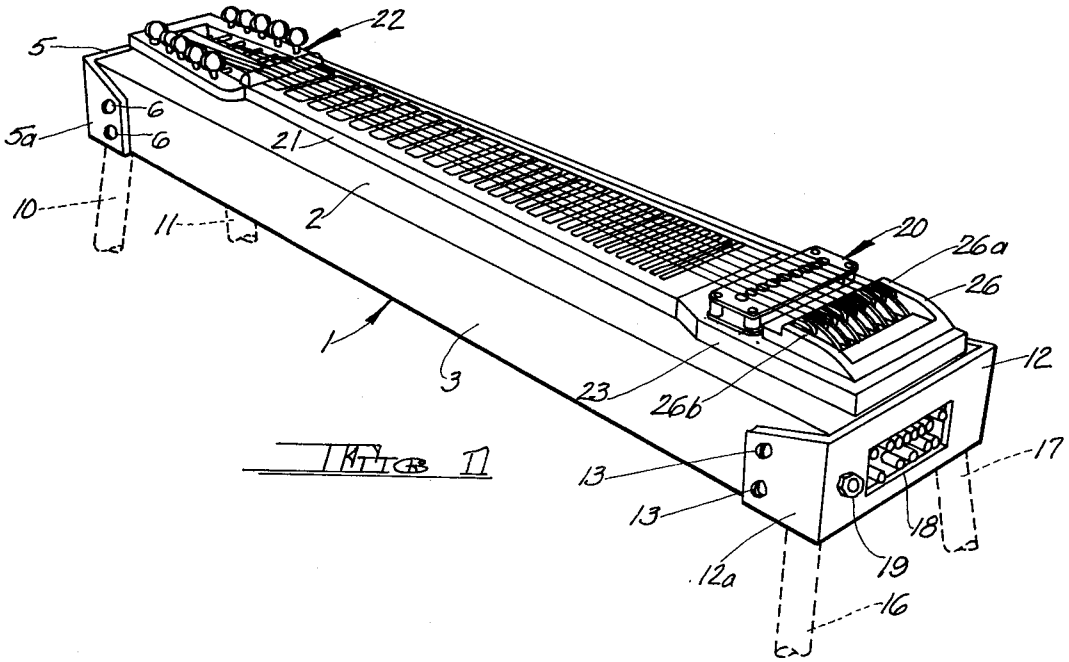
FIG. 1 is a perspective view of an exemplary instrument equipped with the pitch-changing means of the present invention.
Figure 3:
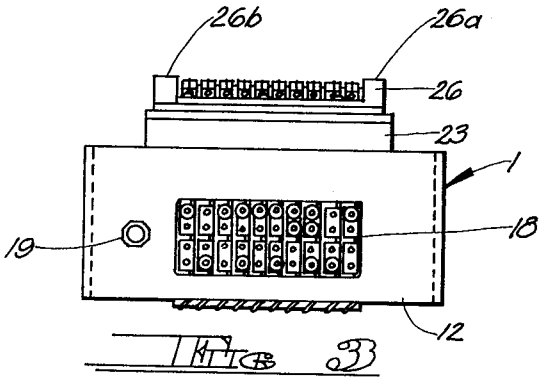
FIG. 3 is a tail end elevational view of the instrument of FIG. 1 as seen from the right of that Figure.

Reference is first made to FIGS. 1 through 3 and 7, wherein like parts have been given like index numerals. The exemplary instrument illustrated is generally indicated at 1. It comprises an elongated structure having a top panel 2 and downwardly depending side panels 3 and 4. The top panel 2 and side panels 3 and 4 may be made of any appropriate material such as wood or the like. The head end of the instrument body is closed by a rectangular metallic member 5 having flanges 5*a* and 5*b* by which it is affixed to side panels 3 and 4 by screws 6. As is most clearly shown in FIG. 7, head end plate 5 is provided with another flange 5*c* adapted to lie along the underside of panel 2 and to be affixed thereto by screws 7. Again, as is most clearly seen in FIG. 7, the corners of head end plate 5 provide threaded sockets 8 and 9 adapted to receive the threaded upper ends of leg elements shown in broken lines in FIG. 1 at 10 and 11, respectively.

The tail end of the instrument is provided with a tail end plate 12 similar to head end plate 5. Thus, tail end plate 12 has a pair of flanges 12*a* and 12*b* extending toward the head end of the instrument and affixed to side panels 3 and 4 by screws 13. The tail end plate 12 is also affixed to the top panel of the instrument by screws (not shown). Again, as can be most clearly seen in FIG. 7, the corners of tail end plate 12 provide threaded sockets 14 and 15 into which the threaded upper ends of leg elements may be engaged. The tail end leg elements are fragmentarily shown in broken lines in FIG. 1 at 16 and 17.

Tail end plate 12 differs from head end plate 5 primarily in that it is provided with an access window 18, the purpose of which will be described hereinafter, and a jack 19 appropriately connected to the pickups (generally indicated at 20) for the strings. It will be understood by one skilled in the art that the amplification means for the instrument do not constitute a part of the present invention and will not be further described.

The elongated neck 21 of the instrument, made of wood or other appropriate material, is mounted on the top panel 2 and extends longitudinally thereof. At the head end of the instrument, the neck terminates in a conventional tuning machine generally indicated at 22.

A metallic plate 23 is mounted on the top panel 2 at the tail end of neck 21. Plate 23 mounts pickups 20. Plate 23 has a perforation 24 therethrough (see FIG. 4) and the top panel 2 has a matching perforation 25. Perforations 24 and 25 are substantially rectangular in configuration with their long dimension extending transversely of the instrument. These perforations accommodate the pitch-changing means of the present invention, as will be described hereinafter. A frame 26 is mounted on plate 23 and surrounds the perforation 24 therein.

Within the head end of frame 26 there is mounted a front pivot plate 27. Front pivot plate 27 is affixed to the structure by screws 28 passing through the front pivot plate, frame 26 and into plate 23. The front pivot plate extends transversely of the instrument and has a tapered edge 27*a* which overlies the perforation 24 in plate 23 and the perforation 25 in top panel 2, as is most clearly shown in FIG. 4. The edge 27*a* of front pivot plate 27 extends transversely of the instrument and serves as a fulcrum or pivot edge, as will be described hereinafter.

Figure 4:
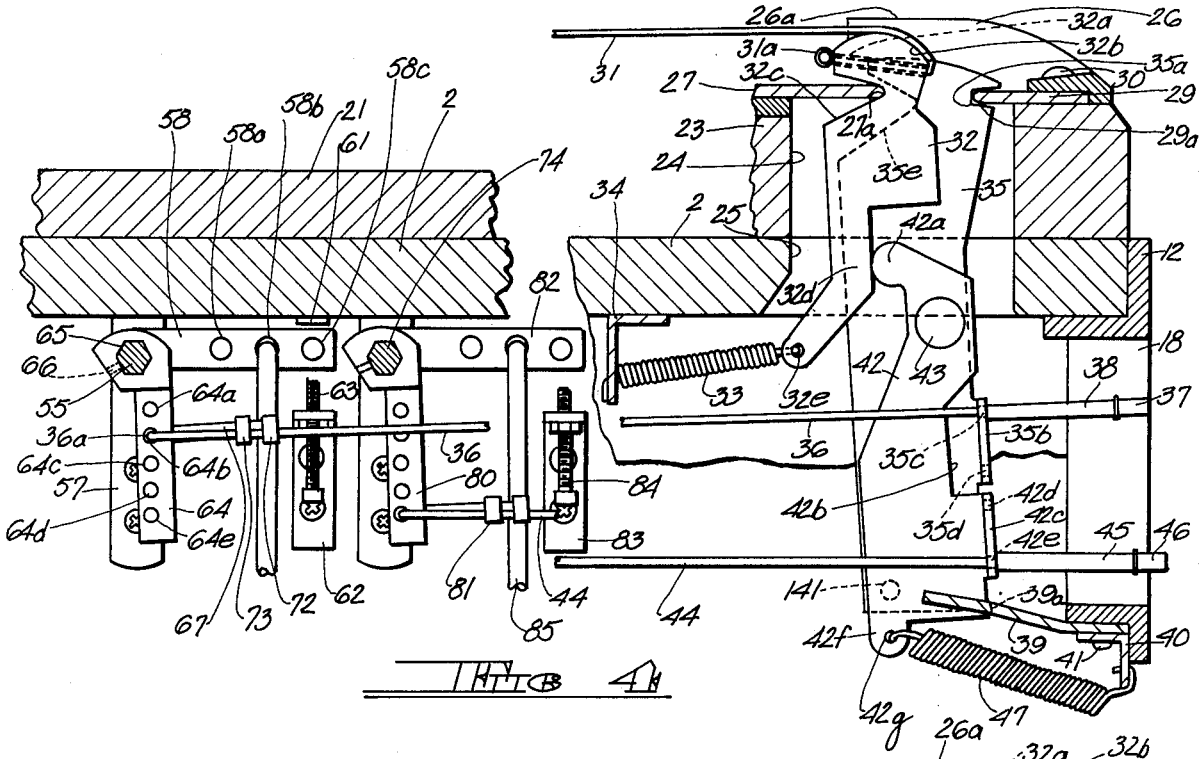
FIG. 4 is a fragmentary longitudinal cross sectional view of the instrument of FIGS. 1 through 3 illustrating a first embodiment of the pitch-changing means of the present invention in its normal position.

As is most clearly shown in FIGS. 2 and 4 a rear pivot plate 29 is mounted on plate 23 beneath frame 26 by screws 30 passing through frame 26, rear pivot plate 29 and into plate 23. Rear pivot plate 29 is substantially rectangular with its long dimension extending transversely of the instrument. As is most clearly shown in FIG. 4, rear pivot plate 29 has a tapered longitudinal edge 29*a* overhanging the perforation 24 in plate 23 and the perforation 25 in top panel 2. This tapered edge 29*a* also serves as a fulcrum or pivot edge, again as will be described hereinafter.

A pitch changing means for one of the strings is illustrated in FIG. 4. Since the pitch-changing means for all of the strings may be identical, the description of one such pitch-changing means will suffice for purposes of description. In FIG. 4 the tail end of string 31 is illustrated as being attached to a string finger 32. String finger 32 has at its upper end a passage 32*a* extending therethrough. String 31 passes through the passage 31*a* and is anchored by means of nut 31*a* attached to the string. String 31 is caused to pass over the arcuate upper surface 32*b* of string finger 32 (which is concentric with fulcrum edge 27*a*) and thereafter extends toward the head end of the instrument. As indicated above, the head end of string 31 will be secured in known fashion to a key of the conventional tuning machine 22.

In its forward edge the string finger 32 is provided with a notch 32*c*. This notch receives the tapered fulcrum edge 27*a* of the forward pivot plate 27. At its lower end, the string finger 32 is provided with a downwardly and forwardly extending leg 32*d* having at its lowermost end a perforation 32*e* adapted to receive the hooked end of a helper spring 33. The other hooked end of helper spring 33 passes through a perforation (not shown) in a downwardly depending leg of a bracket 34. Bracket 34 is of angle iron cross section; is affixed to the underside of top panel 2; and extends transversely of the instrument so that it may serve as an anchor for one end of the helper spring of the string finger for each string.

Adjacent string finger 32 there is located an elongated raising bar 35. The upper rearward edge of raising bar 35 has a notch 35*a* therein adapted to receive the tapered fulcrum edge 29*a* of the rearward pivot plate 29.

Near its lower end raising bar 35 has a flange 35*b* extending laterally from its rearward edge. Flange 35*b* has a pair of perforations 35*c* and 35*d* therethrough. Additional perforations could be provided if desired.

Perforations 35c and 35d are adapted to receive the tail end of one or more pull rods actuable by one or more pedals of the instrument, as will be described hereinafter. For purposes of an exemplary showing, a pull rod 36 is shown passing through perforation 35c in raising bar flange 35b. The tail end of pull rod 36 is threaded (not shown) for receipt of a threaded nut 37. A cylindrical sleeve 38 is mounted on pull rod 36 between the nut 37 and raise bar flange 35b. The purpose of nut 37 will be described hereinafter. It will be noted that the tail end of pull rod 36 extends into the access opening 18 of the tail end plate 12 whereby easy access to nut 37 is gained.

A bracket 39 of S-shaped cross section is affixed at one edge to the underside of tail end plate 12. The bracket 39 extends transversely of the instrument. A second bracket 40 of angle iron cross section is also affixed to the underside of tail end plate 12 and extends transversely of the instrument. Brackets 39 and 40 may be affixed to the underside of tail end plate 12 by screws, one of which is shown at 41, passing through the two brackets and into the underside of the tail end plate. The longitudinal forward edge of bracket 39 is provided with a notch 39a adapted to receive the bottom edge of raising bar 35 to provide a rear stop for the bottom edge of the raising bar and to prevent lateral wabble thereof. Finally, the upper forward edge of raising bar 35 has an enlarged notch (shown in broken lines at 35e) so that in all positions of the raising bar it will clear the fulcrum edge 27a of forward pivot plate 27. It will be understood that lateral shifting of string finger 32 will be prevented by virtue of the fact that string finger 32 is located between its respective raising bar 35 and the raising bar of the next pitch-changing means for the next adjacent string.

The pitch changing means is completed by a lowering bar 42. Lowering bar 42 is at its upper end pivotally attached to raising bar 35 by rivet 43. At its upper end lowering bar 42 is provided with a forwardly extending foot 42a adapted to contact and cooperate with the downwardly depending leg 32d of string finger 32. In its rearward edge lowering bar 42 is provided with a clearance notch 42b providing clearance for the lateral flange 35b of raising bar 35 when the raising bar is shifted as described hereinafter. Beneath clearance notch 42b the lowering bar 42 has its own laterally extending flange 42c having perforations 42d and 42e extending therethrough. Lateral flange 42c of lowering bar 42 serves the same purpose as the raising bar lateral flange 35b, i.e. to receive one or more pull rods. For purposes of an exemplary showing, a pull rod 44 is shown passing through flange perforation 42e. The pull rod 44 is essentially identical to pull rod 36 and is provided with a cylindrical spacer 45 and a nut 46, similar to spacer 38 and nut 37 of pull rod 36.

The lower rear portion of lowering bar 42 is also received within notch 39a of bracket 39. Notch 39a again serves as a rearward stop and a stabilizing means for the lower end of lowering bar 42. It will be understood that bracket 39 will have a similar notch for the lower ends of the raising and lowering bars of each string. Finally, the lowering bar 42 is provided with a downwardly depending extension 42f having a perforation 42g therein for receipt of the hooked end of a lowering bar return spring 47. The other hooked end of return spring 47 is engaged in a perforation (not shown) in the downwardly depending leg of bracket 40.

Figure 16:
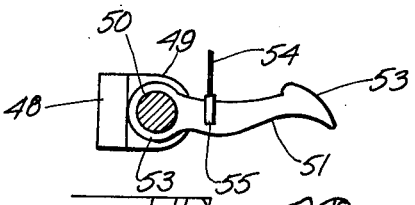
FIG. 16 is a fragmentary side elevational view of an exemplary pedal assembly, with parts in cross section.

Reference is made to FIG. 16 wherein a typical pedal assembly is illustrated. The precise nature of the pedal assembly does not constitute a limitation on the present invention. The pedal assembly comprises a bar 48, the ends of which may be removably affixed to the front legs 11 and 17 of the instrument (see FIG. 1). That surface of bar 48 which faces the rear side of the instrument has a pair of spaced brackets, one of which is shown at 49. The brackets non-rotatively support a shaft 50. A plurality of pedals are rotatively mounted on the shaft 50. One such pedal is shown at 51 having at its pivoted end a sleeve 52 through which shaft 50 extends and having at its other end a foot-engageable portion 53. A pedal connecting rod 54 has at one end means 55 for pivotally attaching it to the shank of pedal 51. The attachment means 55 may be of any appropriate type and is preferably removable either from the end of pedal connection rod 54 or from the shank of pedal 51.

Figure 8:
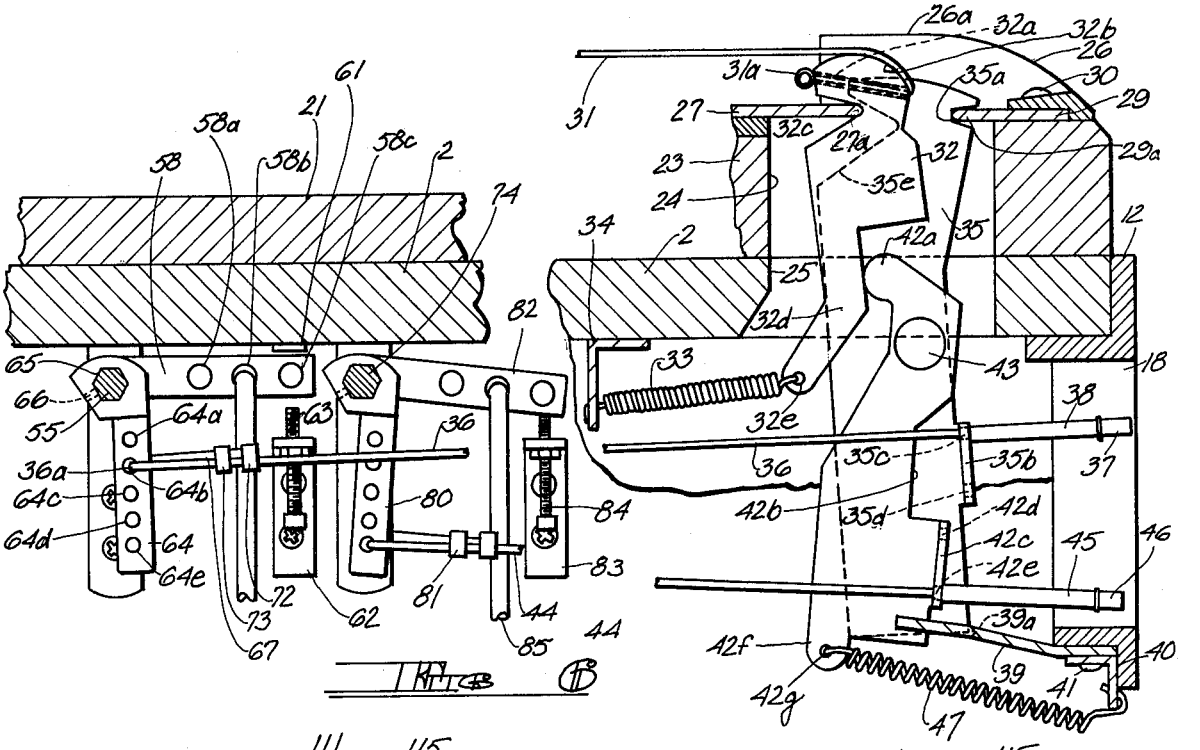
FIG. 8 is a fragmentary cross sectional view taken along section line 8—8 of FIG. 7.

Reference is made to FIGS. 4 and 8 wherein the upper end of pedal connecting rod 54 is illustrated. In the same Figures and FIG. 7 a hexagonal shaft 55 is shown extending transversely of the instrument. One end of the shaft is rotatively mounted in a bracket 56 affixed to the underside of top panel 2 (see FIG. 7). The other end of shaft 55 is rotatively affixed to a bracket 57 affixed to side panel 4 of the instrument.

A pedal crank 58 is provided with a hexagonal perforation 59 so sized as to just nicely receive shaft 55. Pedal crank 58 may be adjusted to proper position longitudinally of shaft 55 and locked therein by set screw 60. Pedal crank 58 has a series of perforations 58a, 58b and 58c. The upper end of pedal connecting rod 54 is configured into a hook shape and is engaged in a convenient one of holes 58a through 58c. In FIG. 8 it is shown in hole 58b.

It will be immediately evident from FIGS. 8 and 16 that if pedal 51 is depressed by the instrument operator's foot, pedal connecting rod 54 will pull downwardly on pedal crank 58. This will in turn, cause shaft 55 to rotate in a clockwise direction as viewed in FIGS. 4 and 8. A pad of resilient material 61 may be mounted on the underside of top panel 2 above pedal crank 58 to prevent contact of the underside of top panel 2 by the pedal crank and any noise which might result therefrom. The amount by which pedal 51 and pedal connecting rod 54 cause shaft 55 to turn can be adjusted by the provision of an adjustable stop for pedal crank 58. Such an adjustable stop is illustrated in FIGS. 4 and 8 and comprises a bracket 62 affixed to the instrument side panel 4 and supporting an adjustment screw 63. Screw 63 comprises an adjustable stop determining the bottom most position achieveable by pedal crank 58, and thereby the amount of clockwise rotation imparted to shaft 55.

Returning to FIG. 4, a pull rod crank 64 is also mounted on shaft 55. Pull rod crank 64 is similar in construction to pedal crank 58, having a hexagonal hole 65 so sized as to just nicely receive shaft 55. Pull rod crank 64 is slidable longitudinally along shaft 55 and when located in its proper adjusted position (see FIG. 7), it may be locked in place on shaft 55 by means of a set screw 66.

At this point it may be noted that shaft 55, perforation 59 in pedal crank 58 and perforation 65 in pull rod crank 64 may have configurations other than hexagonal. For example, shaft 55 may be of circular cross section and holes 59 and 65 may be of matching circular configuration. A polygonal cross section for shaft 55 and a matching polygonal configuration for holes 59 and 65 are preferred since they will assure that cranks 58 and 64 will not slip about the axis of shaft 55 during operation of the instrument.

As will be clearly noted in FIG. 4, pull rod crank 64 is so located on shaft 55 as to depend downwardly. Pull rod crank 64 is provided with a plurality of perforations 64*a* through 64*e*, any one of which may serve to receive the hook-shaped end of a pull rod. In the exemplary embodiment shown in FIG. 4, the hooked end 36*a* of pull rod 36 is shown as being engaged in perforation 64*b* of pull rod crank 64. It will be immediately evident that if pedal 51 (FIG. 16) is depressed, its pedal connecting rod 54 will cause clockwise rotation of pedal crank 58 and therefore clockwise rotation of shaft 55 and pull rod crank 64. This, in turn, will apply a pulling force to pull rod 36 toward the left as viewed in FIG. 4 (i.e., toward the head end of the instrument). Shaft 55 is provided with a torsion spring 55*a* which will return shaft 55 and pedal 51 to their normal positions, relieving the string from this burden.

The choice of which perforation 64*a* through 64*e* in which to engaged the hooked end 36*a* of pull rod 36 will depend upon the amount of pull required to bring the string in question to the desired pitch, each string requiring a different amount of tension. It will be evident from FIG. 4 that a greater amount of pull will be applied to pull rod 36 if mounted in perforation 64*e* of pull rod crank 64 than if mounted in perforation 64*a*.

Figure 15:
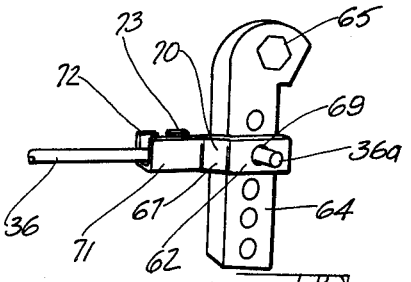
FIG. 15 is a fragmentary perspective view illustrating the spring clip by which the head end of a pull rod is affixed to a pull rod crank.

The hooked end 36*a* of pull rod 36 may be firmly locked in the selected hole in the pull rod crank by means of a simple spring clip 67. Reference is made to FIGS. 4 and 15 wherein clip 67 is most clearly shown. Clip 67 comprises an elongated element having a first portion 68 adapted to lie along the side of pull rod crank 64 and provided with a perforation 69 to receive the hooked end 36*a* of pull rod 36. Clip 67 has a second portion 70 bent inwardly toward pull rod 36 and a third portion 71 adapted to lie adjacent pull rod 36 and provided with a pair of integral spring fingers 72 and 73. Spring fingers 72 and 73 are of S-shaped configuration so as to engage pull rod 36 with a snap fit. It will be evident from FIG. 16 that clip 67 provides an easily releasable means for locking the hooked end of pull rod 36 to pull rod crank 64. Clip 67 may be made of any appropriate resilient material such as metal, plastic or the like.

Returning to FIG. 7 it will be noted that the instrument is provided with a plurality of transversely extending shafts 74 through 80 equivalent to shaft 55. Each of these shafts is rotatable by pedal means, each has a torsion spring equivalent to spring 55*a* and each may be provided with one or more cranks equivalent to pull rod crank 64 for engagement by a pull rod operatively connected to the raising bar or lowering bar of a selected one of the pitch-changing means. Since the cranks similar to pull rod crank 64 are adjustable along the length of their respective shafts 55 and 74 through 80, any appropriate "set-up" of the instrument may be easily and quickly achieved.

For purposes of description, in FIG. 4 pull rod 44 operatively connected to lowering bar 42 is shown as being attached to a pull rod crank 80 equivalent to pull rod crank 64 by spring clip 81 equivalent to clip 67. Pull rod crank 80 is mounted on transverse shaft 74 provided with a pedal crank 82 equivalent to pedal crank 58. Pedal crank 82 is shown as being provided with an adjustable stop means 83–84 equivalent to stop means 62–63 and has connected thereto a pedal connecting rod 85 leading to a pedal (not shown) similar to pedal 51 of FIG. 16.

At this point, the operation of the pitch-changing means of the present invention may be described. Once the instrument has been basically set up, the adjustable stop 62–63 for pedal crank 58 will be set such that pedal 51 will cause that amount of rotation of shaft 55 required to achieve the proper tension in that one of the strings controlled by shaft 55 requiring the greatest travel of its respective pull rod crank. The same is of course true of the adjustable stop means 83–84 for pedal crank 82 and all of the other adjustable stops for the pedal cranks of the additional shafts 75 through 80.

The pitch changing means of the present invention is shown in its normal position in FIG. 4. String finger 32 is held in its position against the fulcrum edge 27*a* of forward pivot plate 27 by the tension of string 31 and the contact of the rear surface of string finger leg 32*d* by the foot 42*a* of lowering bar 42. Helper spring 33 attached to spring finger leg 32*d* is selected so as to counteract, in part at least, the tension of string 31 so that the force required to pivot string finger 32 is lessened.

The tension of string 31, operating through string finger 32 and its engagement with the foot 42*a* of lowering bar 42, together with the pivotal attachment of lowering bar 42 to raising bar 35 by means of pivot pin 43, will keep raising bar notch 35*a* fully seated on the fulcrum edge 29*a* of rearward pivot plate 29 and the lower end of raising bar 35 fully seated within notch 39*a* of bracket 39.

Finally, lowering bar 42 will be maintained in the position shown by virtue of the contact of lowering bar foot 42*a* and leg 32*d* of string finger 32, the lower end of lowering bar 42 being maintained fully seated within notch 39*a* of bracket 39 by return spring 47. With all of the elements in their normal positions as shown in FIG. 4, string 31 is tuned open tuning by means of the conventional tuning machine 22 (see FIG. 2).

Figure 5:
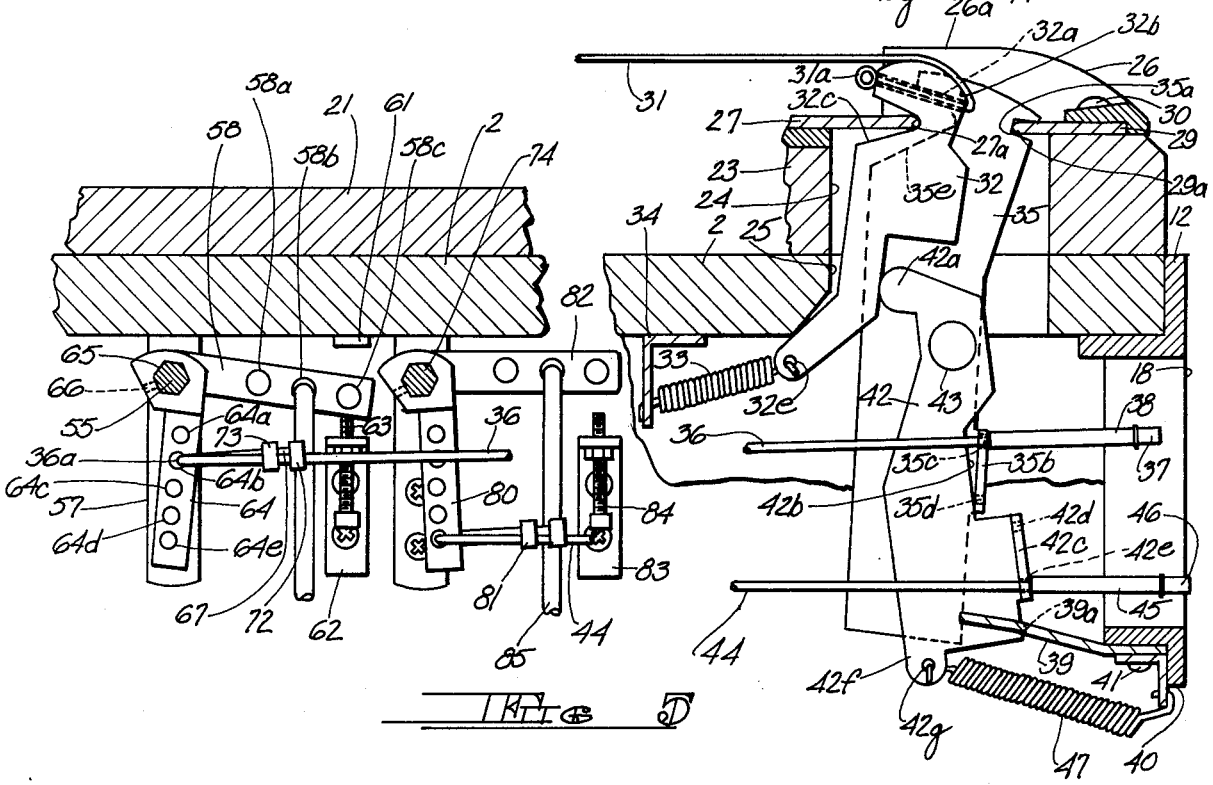
FIG. 5 is a fragmentary longitudinal cross sectional view, similar to FIG. 4, and illustrating the pitch-changing means in its pitch-raising position.

To raise the pitch of string 31 it is necessary to apply a pulling force to that pull rod operatively connected to raising bar 35. Reference is made to FIG. 5. Assuming that pedal 51 (FIG. 16) has been depressed by the instrument operator, the action of pedal connecting rod 54 will cause pedal crank 58 to pivot in a clockwise direction (as seen in FIG. 5) to a position against the adjustable stop 62–63. This, in turn, will cause clockwise rotation of shaft 55 and pull rod crank 64. Pull rod crank 64 will exert a pulling force on pull rod 36, shifting it to the left in FIG. 5 (i.e. toward the head end of the instrument). Pull rod 36, in turn, will cause raising bar 35 to pivot in a clockwise direction (as viewed in FIG. 5) about fulcrum edge 29*a* of rearward fulcrum plate 29. This will cause the lower end of raising bar 35 to shift part way out of the slot 39*a* of bracket 39.

The lower end of lowering bar 42 will remain fully seated in notch 39*a* of bracket 39 by virtue of return spring 47. The upper end of lowering bar 42, however, will be shifted forwardly since it is pivotally attached at 43 to raising bar 35. The forward shifting of the upper end of lowering bar 42 will cause lowering bar foot 42*a* to shift string finger leg 32*d* forwardly. This will cause a clockwise rotation of string finger 32 about fulcrum edge 27*a* of forward pivot plate 27. In this manner tension in string 31 will be increased with the result that the string pitch will be increased. Final adjustment of the amount by which the pitch of string 31 is increased can be made by tightening or loosening nut 37 on the threaded tail end of pull rod 36. When pedal 51 is released the tension of string 31 will cause the elements of the pitch-changing means to return to their normal positions as illustrated in FIG. 4.

To lower the pitch of string 31 it is necessary to apply a pulling force on pull rod 44 operatively connected to lowering bar 42. This situation is illustrated in FIG. 6. In that Figure it will be noted that the pedal (not shown) controlling pedal connecting rod 85 has been depressed, and pedal connecting rod 85 has caused pedal crank 82, shaft 74 and pull rod crank 80 to rotate in a clockwise direction (as viewed in FIG. 6) to the extent permitted by adjustable stop 83–84. This, in turn, applies a pulling force to pull rod 44, causing pull rod 44 to shift to the left as viewed in FIG. 6 (i.e. toward the head end of the instrument).

When this occurs lowering bar 42 will pivot in a clockwise direction about rivet 43. Raising bar 35 will remain in its normal position and the lower end of lowering bar 42 will shift partway out of notch 39*a* in bracket 39. At the same time, the foot 42*a* of lowering bar 42 will shift rearwardly due to its clockwise rotation and the tension on string 31 will cause the leg 32*d* of string finger 32 to follow foot 42*a* of lowering bar 42. In this way, string finger 32 will pivot in a counterclockwise direction (as viewed in FIG. 6) about the fulcrum edge 27*a* of forward pivot plate 27, reducing the tension on string 31 and thereby lowering its pitch. The amount by which the pitch of string 31 is lowered can be accurately adjusted by means of nut 46 on the threaded tail end of pull rod 44. Again, when the pedal controlling connecting rod 85 is released, the elements of the pitch-changing means will return to their normal positions as illustrated in FIG. 4.

Not all of shafts 55 and 74 through 80 need be actuated by a foot pedal. They may, for example, be actuated by a knee pedal. Reference is made to FIGS. 7 and 9. In these Figures, shaft 79 is shown rotatively mounted in brackets 86 and 87 mounted on the underside of the instrument top panel 2. It will be understood that the apparatus illustrated in FIG. 9 is shown in inverted position. Shaft 79 carries a pull rod crank 79a with a pull rod 79b affixed thereto. A generally L-shaped member 89 is also mounted on shaft 79. Element 89 has a first downwardly depending leg 89*a*. To this leg there is pivotally affixed by pivot pin 90 a knee pedal 91. It will be apparent from FIG. 9 that if knee pedal 91 is shifted to the left (as viewed in that Figure) a counterclockwise rotation will be imparted to shaft 79 and pull rod crank 79*a*. This, in turn, will apply a pulling force to pull rod 79*b* in a direction toward the head end of the instrument causing that pitch-changing means to which pull rod 79*b* is attached to raise or lower the pitch of its respective string, depending upon whether pull rod 79*b* is operatively engaged with the raising bar or the lowering bar of the pitch-changing means. The amount by which knee pedal 91 rotates pull rod crank 79*a* may be determined by stop means. To this end, FIG. 9 illustrates a bracket 92 mounted to the underside of top panel 2 and supporting an adjustment screw 93 serving as a stop for the leg 89*a* of element 89. The other leg 89*b* of element 89 is not used in the embodiment illustrated in FIG. 9. The purpose of leg 89*b* will next be described.

Figure 10:
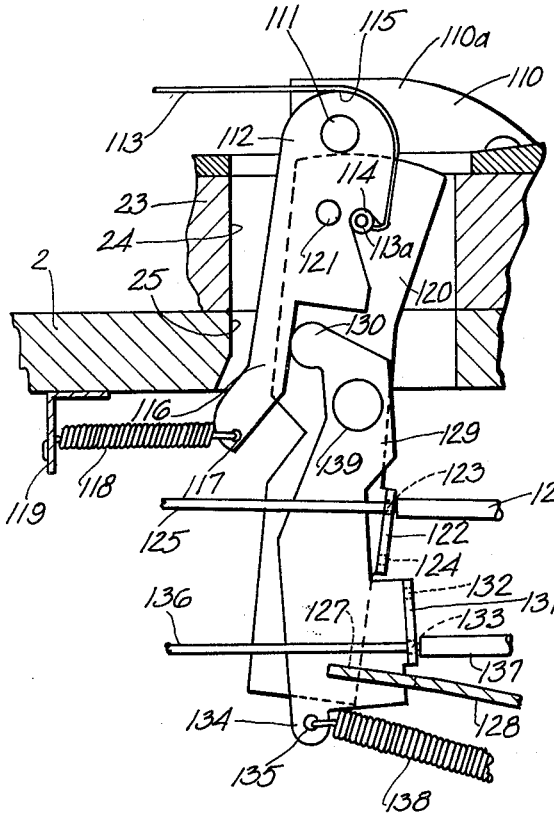
FIG. 10 is a fragmentary cross sectional view taken along section line 10—10 of FIG. 7.

In some instances it may be desirable to have the instrument operator's knee actuate two knee pedals. This is most conveniently done by having one knee pedal actuated when the operator's knee is shifted toward the head end of the instrument (as in the embodiment of FIG. 9) and to have a second knee pedal actuated when the operator's knee is shifted toward the tail end of the instrument. To accomplish this latter purpose, a knee pedal may be mounted on one transverse shaft to remotely impart proper rotation to a next adjacent transverse shaft. This instance is illustrated in FIG. 10. Shaft 78 is shown in FIG. 7 as being rotatively mounted in brackets 94 and 95 affixed to the underside of instrument top panel 2. Bracket 95 is shown in FIG. 10 as being provided with a bushing 96 through which shaft 78 extends. Mounted on that end of shaft 78 adjacent side panel 3 of the instrument there is an L-shaped member 97 identical to member 89 of FIG. 9. Element 97 has a first downwardly depending leg 97*a* (it again being understood that the structure is shown in inverted position in FIG. 10). To this leg there is pivotally affixed by pivot pin 98 the bifurcated end of a knee pedal 99 identical to knee pedal 91 of FIG. 9. When the instrument is being used, pedal 99 will be in the position shown, i.e. depending downwardly from the underside of the instrument. When the knee pedal is not in use, it may be rotated counterclockwise (as viewed in FIG. 10) until its surface 100 abuts the leg 97*a* of element 97, in which position the knee pedal 99 will be substantially horizontally oriented and parallel to the instrument top panel 2 within the confines of the instrument side panels for ease in carrying and packing the instrument. When knee pedal 99 is in its downwardly depending position, its interior surface 101 abuts leg 97*a* of element 97*a* of element 97 so that the knee pedal can cause element 97 and shaft 78 to rotate in a clockwise direction (as viewed in FIG. 10) when the operator's knee is shifted toward the tail end of the instrument. It will be understood that the knee pedal 91 of FIG. 9 is capable of folding out of the way for packing and the like in the same manner described with respect to knee pedal 99 of FIG. 10.

The element 97 has a hole (not shown) through which shaft 78 extends. This hole is of corresponding configuration to the cross sectional configuration of shaft 78 and the element 97 may be locked in position on shaft 78 by means of set screw 102.

The purpose of knee pedal 99 is to remotely cause rotation of shaft 77. To this end, shaft 77 is shown in FIG. 7 as being rotatively mounted in brackets 103 and 104. Shaft 77 is provided with a crank 105 substantially identical to crank 58 of FIG. 8. Crank 105 is provided with a plurality of perforations 105*a* through 105*c*. One of these perforations (in the exemplary embodiment illustrated, perforation 105*b*) is provided with a roll pin 106 which extends into a slot 107 in the leg 97*b* of element 97.

It will be evident from FIG. 10 that as knee pedal 99 is rotated in a clockwise direction together with shaft 78, the cooperation of leg 97*b* of element 97 and crank 105 will cause shaft 77 to be rotated in a counterclockwise direction (as viewed in FIG. 10). This, in turn, will cause pull rod crank 77*a* mounted on shaft 77 to be rotated toward the head end of the instrument, exerting a pulling force on pull rod 77*b* attached thereto. The amount by which element 97 may be rotated by pedal 99 can be regulated by an adjustable stop. Such an adjustable stop is illustrated in FIG. 10 as comprising a bracket 108 mounted to the underside of instrument top panel 2 and equivalent to bracket 92 of FIG. 9. Bracket 108 supports an adjustment screw 108*a* equivalent to adjustment screw 93 of FIG. 9 and serving as a stop for element 97.

It will be noted that the leg 89b of element 89 of FIG. 9 and the leg 97b of element 97 of FIG. 10 are provided with identical notches 89c and 97c, respectively. The purpose of these notches is to enable these legs to clear an adjacent transverse shaft, should one be present. An instance of this is illustrated in FIG. 7 wherein shaft 75 is shown provided with a knee pedal 75a identical to knee pedal 91 of FIG. 9, and an L-shaped element 109 identical to element 89 having an upstanding leg 109a and a horizontal leg 109b. The horizontal leg 109b will be provided with a notch (not shown) equivalent to notch 89c of FIG. 9 so that the leg 109b will not touch or interfere with adjacent transverse shaft 76.

Figure 11:
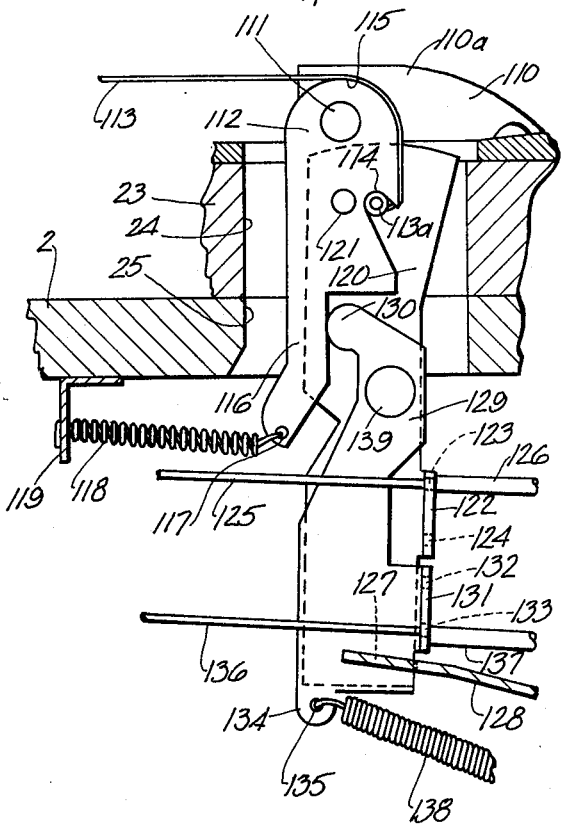
FIG. 11 is a fragmentary elevational view, partly in cross section, illustrating a second embodiment of the pitch-changing means of the present invention in its normal position.
Figure 13:
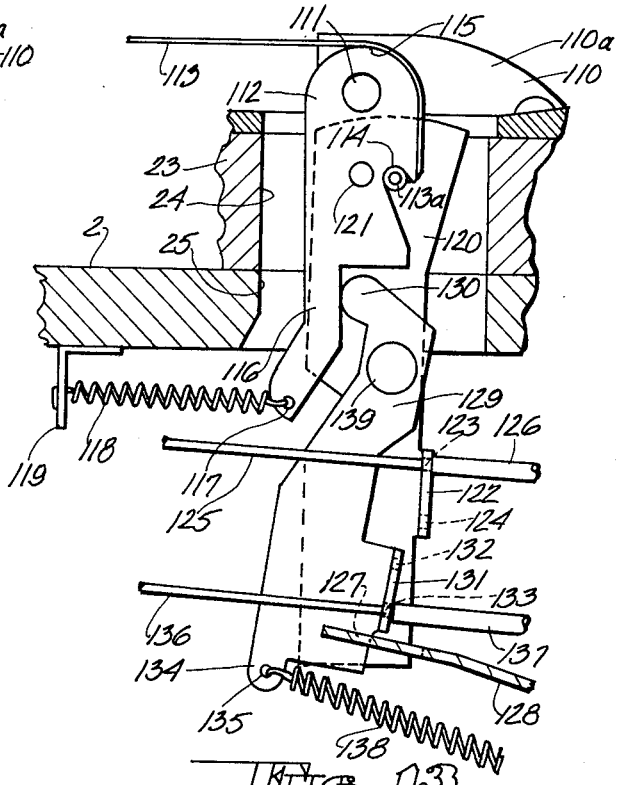
FIG. 13 is a fragmentary elevational view, partly in cross section, and similar to FIG. 11, illustrating the pitch-changing means of FIG. 11 in its pitch-lowering position.

FIGS. 11 through 13 illustrate another embodiment of the pitch-changing means of the present invention. The instrument again has a top panel 2 and a plate 23 mounted thereon at the tail end. As in the case of the structure of FIG. 4, plate 23 has an opening 24 therein and the instrument top panel 2 has a matching opening 25. The opening 24 in plate 23 is surrounded by a frame 110 equivalent to frame 26 of FIGS. 1 and 4. Frame 110 is mounted on top of plate 23 and differs only in that this embodiment has no forward and rearward pivot plates and no accommodation is made in frame 110 for such plates. Frame 110 has a pair of upstanding ears, one of which is shown at 110a. These ears are equivalent to ears 26a and 26b of frame 26 (see FIG. 1). In this embodiment, a shaft 111 is mounted between the ears of Frame 110. The shaft 111 extends transversely of the instrument and the string finger 112 for string 113 is pivotally mounted thereon. It will be understood that a similar string finger for each of the other instrument strings will also be pivotally mounted on shaft 111.

String finger 112 is provided at its rear end with a notch 114 adapted to receive the anchoring nut 113a of string 113. The arcuate upper surface 115 of string finger 112 is concentric with shaft 111.

As in the case of string finger 32 of FIG. 4, string finger 112 of FIG. 11 has a downwardly and forwardly depending leg 116, the bottom end of which is provided with a perforation 117 for the receipt of the hooked end of a helper spring 118. The other end of helper spring 118 is provided with a hooked end engaged in a perforation (not shown) in a bracket 119 of angle iron cross section and mounted on the under surface of the instrument top panel 2. Helper spring 118 is equivalent to helper spring 33 of FIG. 4 and bracket 119 is equivalent to bracket 34 of FIG. 4.

A raising bar is indicated at 120. Raising bar 120 differs from raising bar 35 of FIG. 4 primarily in that it is pivotally attached at its upper end to string finger 112 by a rivet or pivot pin 121. In most other respects, raising bar 120 of FIG. 11 is similar to raising bar 35 of FIG. 4 and has a laterally extending flange 122 on its rearward edge provided with perforations 123 and 124. Perforations 123 and 124 are adapted to receive pull rods and to this end a pull rod 125 is shown extending through perforation 123. Pull rod 125 is equivalent to pull rod 36 of FIG. 4 and is provided with a cylindrical spacer 126 equivalent to spacer 38 of FIG. 4. The tail end of pull rod 125 is threaded and will be provided with an adjusting nut (not shown), intended to serve the same purpose as nut 37 of FIG. 6. The lowermost end of raising bar 120 is engaged in the notch 127 of a bracket 128. Bracket 128 is equivalent to bracket 39 of FIG. 4 and again serves the same purpose.

A lowering bar 129 is provided which is identical to lowering bar 42 of FIG. 4. Thus, lowering bar 129 has at its upper end a forwardly extending foot 130 equivalent to foot 42a of FIG. 4, an integral laterally extending flange 131 provided with perforations 132 and 133 equivalent to flange 42c of FIG. 4 and its perforations 42d and 42e, and a downwardly depending lug 134 having a perforation 135 therein, equivalent to lug 42f and perforation 42g of FIG. 4. In FIG. 11 lowering bar 129 is shown as having a pull rod 136 extending through flange perforation 133. Pull rod 136 is equivalent to pull rod 44 of FIG. 4 and is provided with a cylindrical spacer 137 equivalent to cylinder spacer 45 of FIG. 4. It will be understood that the tail end of pull rod 136 will have an adjustment nut (not shown) equivalent to adjustment nut 46 of FIG. 4.

A return spring is shown at 138. Return spring 138 is equivalent to return spring 47 of FIG. 4. One end of return spring 138 is engaged in the perforation 135 of lowering bar lug 134. The other end of return spring 138 (not shown) may be mounted on a bracket (not shown) in the same manner illustrated in FIG. 4. It will be noted that the lower end of lowering bar 129 is located in slot 127 of bracket 128, slot 127 serving to stabilize the lower ends of both raising bar 120 and lowering bar 129. At its upper end, lowering bar 129 is pivotally affixed to raising bar 120 by rivet or pivot pin 139.

The remainder of the stringed instrument, including the means for actuating pull rods 125 and 136, may be the same as described above. This is true also of the "set-up" of the instrument. It will be understood that the embodiment of the pitch-changing means shown in FIG. 11 is illustrated in that Figure in its normal or neutral position. With the parts in this position, string 113 is tuned open tuning by means of a conventional tuning machine, in the same manner described with respect to the embodiment of FIG. 4.

String finger 112 will normally be maintained in the position shown in FIG. 11 by means of the tension of string 113 and the contact of the rear surface of string finger leg 116 by foot 130 of lowering bar 129. Raising bar 120 will be maintained in the position shown by virtue of the fact that it is pivoted to string finger 112 at 121 and by virtue of the fact that it is pivotally attached to lowering bar 129 as at 139. It will be noted that raising bar 120, in its neutral or normal position, is fully seated at its lower end in notch 127 of bracket 128. Finally, lowering bar 129 will be maintained in the position shown by virtue of its pivotal attachment to raising bar 120 at 139 and by means of return spring 138. It will be noted that the lower end of lowering bar 129 is also fully seated within the notch 127 of bracket 128.

When a pulling force is applied to pull rod 125 operatively attached to raising bar 120) in a direction toward the head end of the instrument, the elements of the pitch-changing means will assume the position shown in FIG. 12. Raising bar 120 will pivot about pivot pin 121 in a clockwise direction, shifting the lower part of the raising bar partway out of notch 127 of bracket 128. This, in turn, will shift foot 130 of lowering bar 129 forwardly (the lower end of lowering bar 129 remaining fully seated within notch 127 of bracket 128 through the action of lower return string 138). This movement of the upper end of lowering bar 129 will cause foot 130 to engage the downwardly depending leg 116 of string finger 112 causing the string finger to pivot about shaft 111 in a clockwise direction (as viewed in FIG. 12), thereby increasing the tension in string 131 and thus raising its pitch. The amount by which the pitch of sring 113 is raised may be finely adjusted by an adjustment nut (not shown) on the tail end of pull rod 125, in the manner described with respect to nut 37 on pull rod 36 of FIG. 5.

If the pitch of string 113 is to be lowered, a pulling force toward the head end of the instrument will be applied to pull rod 136. When this occurs, the elements of the pitch-changing means will assume the positions illustrated in FIG. 13. Thus, raising bar 121 will remain fully seated in notch 127 of bracket 128. Pull rod 136 will cause lowering bar 129 to rotate about pivot pin 139 in a clockwise direction (as viewed in FIG. 13) causing foot 130 to shift in a clockwise direction. The tension of string 113 will cause the downwardly depending leg 116 of string finger 112 to follow foot 130, resulting in a counterclockwise rotation of string finger 112 about shaft 111. This rotation of the string finger will reduce the tension in string 113 and thereby lower its pitch. The amount by which the pitch is lowered in string 113 can be finely adjusted by means of an adjustment nut (not shown) mounted on the tail end of pull rod 136 and the same manner described with respect to adjustment nut 46 on pull rod 44 in FIG. 6.

In the embodiment illustrated in FIGS. 11 through 13, helper spring 118 again serves as a counterbalance for the tension on string 113 to reduce the force required to cause string finger 112 to shift from its normal position.

Figure 14A:
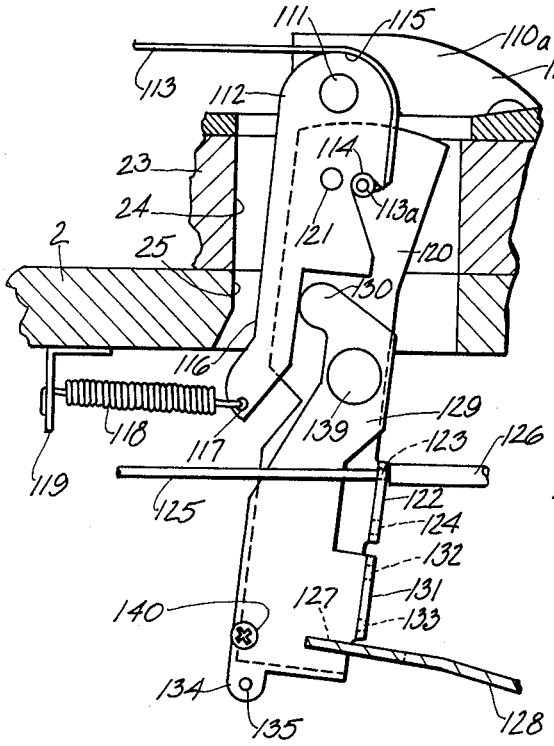
FIG. 14 is a fragmentary elevational view, partly in cross section, and illustrating a modification of the structure of FIG. 11.

In an instance where string 113 is to be raised in pitch only, it is within the scope of the invention to mechanically join the lower ends of the raising bar 120 and the lowering bar 129. This is illustrated in FIG. 14 wherein the lower ends of raising bar 120 and lowering bar 129 are joined together by an appropriate fastening means such as screw 140. In FIG. 14 the elements of the pitch-changing means are shown in their pitch-raising positions. Assuming a force is applied to pull rod 125 to the left as viewed in FIG. 14 (i.e., toward the head end of the instrument), the raising bar 120 and lowering bar 129 will shift together in a clockwise direction. The contact between the lowering bar foot 130 and the downwardly depending leg 116 of string finger 112 will result in a clockwise rotation of string finger 112 (as viewed in FIG. 14) about shaft 111. When the pulling force is no longer applied to pull rod 125, the parts will be returned to their normal position (i.e. the position shown in FIG. 11) by virtue of the tension of string 113. The advantage of mechanically joining the lower ends of raising bar 120 and lowering bar 129 lies in the fact that one or more pull rods to increase the tension on string 113 may be located in either or both of the holes 123 and 124 in raising bar flange 122 or in either or both of holes 132 and 133 in flange 131 of lowering bar 129. Since, as indicated above, the tension of string 113 will return the structure to its normal position upon release of the pulling force from pull rod 125, lower return spring 138 may be eliminated, as is shown in FIG. 14.

It will be understood by one skilled in the art that in the embodiment illustrated in FIG. 4, if string 31 is to be raised only, the bottom ends of raising bar 35 and lowering bar 42 may be mechanically joined together in the same manner described with respect to FIG. 14. To this end, an appropriate fastening means in the form of a screw 141 is shown in broken lines in FIG. 4. Again, return spring 47 could be eliminated.

Modifications may be made in the invention without departing from the spirit of it.

The embodiments of the invention in which an exclusive property or privilege is claimed are defined as follows:

1. In a stringed instrument of the type having a head end, a tail end, a conventional tuning machine at its head end, a plurality of strings affixed at their head ends to said tuning machine, a pitch-changing means for raising and lowering by a determined amount the predetermined tuned pitch of individual ones of said instrument strings and a plurality of pedals for actuating said pitch-changing means, the improvement comprising a pitch-changing assembly for each of said instrument strings extending downwardly through an opening at said tail end of said instrument, said opening being substantially rectangular in configuration with its long dimension extending traversely of said instrument, fulcrum means mounted above said opening, each of said pitch-changing assemblies comprising a string finger, a raising bar and a lowering bar, said string finger having an upper end extending above said opening to which the tail end of one of said instrument strings is attached, said string finger having a lower end terminating in a leg extending below said opening, said string finger being pivotable about said fulcrum means from a normal position to a pitch-raising position in which the tension of said string attached thereto is increased and to a pitch-lowering position in which the tension of said string attached thereto is reduced, said raising bar being located adjacent and to one side of said string finger and having a lower end extending below said opening, said raising bar being pivotally attached to its respective string finger to pivot between a normal position and a pitch-raising position, said lowering bar being pivotally attached to said raising bar and being located to the same side thereof as said string finger, said lowering bar being pivotable between a normal position and a pitch-lowering position, said lowering bar having a lower end extending below said opening and having a foot at its upper end in abutment with said string finger leg, means for operatively attaching at least one pull rod to said raising bar whereby when a pulling force is applied to said raising bar pull rod toward the head end of said instrument said raising bar will pivot to said raising position urging said lowering bar foot against said string finger leg to pivot said string finger to said pitch-raising position, means for operatively attaching at least one pull rod to said lowering bar whereby when a pulling force is applied to said lowering bar pull rod toward the head end of said instrument said lowering bar will pivot to said lowering position and said lowering bar foot will shift in a direction away from said string finger leg to permit said string finger to pivot to said pitch-lowering position, means to normally retain said string finger, said raising bar and said lowering bar in their normal positions, a plurality of pull rods operatively attached to selected ones of said raising and lowering bars of said pitch-changing assemblies and means to operatively connect said pull rods to selected ones of said pedals by which a pulling force may be applied to said pull rods.

2. The structure claimed in claim 1 wherein said stringed instrument is an electric steel guitar.

3. The structure claimed in claim 1 wherein said fulcrum means comprises a shaft mounted traversely of said instrument, said string fingers being pivotally mounted thereon.

4. The structure claimed in claim 1 including a plurality of shafts rotatively mounted on the underside of said instrument and extending transversely thereof, selected ones at least of said shafts having downwardly depending pull rod cranks non-rotatively mounted thereon, the head end of each of said pull rods having a hook shaped configuration, each of said pull rod cranks having at least one perforation therethrough to receive said hooked end of one of said pull rods, and means operatively connecting selected ones of said shafts to selected ones of said pedals by which rotation may be imparted to said shafts and said pull rod cranks thereon to apply said pulling force toward the head end of said instrument to said pull rods connected thereto.

5. The structure claimed in claim 4 wherein said stringed instrument is an electric steel guitar.

6. The structure claimed in claim 5 including an L-shaped element mounted on a first one of said shafts with one leg of said L-shaped member depending downwardly and one leg thereof extending substantially horizontally toward the head end of said instrument and toward a second adjacent one of said shafts having at least one of said pull rod cranks mounted thereon, a knee pedal being pivotally mounted on said downwardly depending leg and being shiftable thereon between a downwardly depending position and a folded substantially horizontal position extending toward the head end of said instrument, said second shaft having a pedal crank mounted thereon so as to normally extend substantially horizontally toward said first shaft and the tail end of said instrument, said horizontal leg of said L-shaped element having a slot herein, said pedal crank having a laterally extending pin engaged in said slot of said horizontal leg of said L-shaped member whereby when said knee pedal is in its downwardly depending position and is shifted toward the tail end of said instrument by the operator's knee the interaction of said horizontal leg of said L-shaped element and said pedal crank will rotate said second shaft and said at least one pull rod crank mounted thereon, and an adjustable stop means cooperating with said downwardly depending leg of said L-shaped member to determine the amount by which said second shaft is rotated by said knee pedal.

7. The structure claimed in claim 4 wherein said shafts are of non-circular cross section, each of said pull rod cranks having a perforation therethrough of matching configuration and sized to just nicely receive its respective one of said shafts, each of said pull rod cranks being adjustable in position along its respective shaft, each of said pull rod cranks having a set screw by which it may be locked in adjusted position on its respective shaft.

8. The structure claimed in claim 4 including spring clip means to releasably maintain said hooked end of a pull rod in said perforation in its respective pull rod crank, said spring clip having a first end lying adjacent said pull rod crank with a perforation therein coaxial with said pull rod crank perforation through which said hooked end of said pull rod extends, said hooked end of said pull rod also extending through said spring clip perforation, said spring clip having a second end adapted to lie adjacent said pull rod with laterally extending spring fingers engaging said pull rod with a releasable snap fit.

9. The structure claimed in claim 4 wherein each of said raising bars and said lowering bars has a laterally extending flange, each of said flanges having at least one perforation through which the tail end of one of said pull rods may extend, the tail end of each pull rod being threaded and having an adjustment nut threadedly engaged thereon, a cylindrical spacer being mounted on the tail end of each pull rod between said adjustment nut and said flange through which said pull rod extends, whereby said adjustment nuts may be used to finally adjust the amount by which the pitch of an instrument string is raised or lowered by a pulling force toward the head end of the instrument applied to the pull rod for that string.

10. The structure claimed in claim 4 including a pedal crank mounted on selected ones of said shafts in such a way as to normally extend in a substantially horizontal position toward the tail end of said instrument, each of said pedal cranks having at least one perforation therethrough, a downwardly depending pedal connecting rod operatively connected at its lower end to one of said pedals and having a hook-shaped upper end engaged in said pedal crank perforation, whereby when said pedal is depressed downwardly the downward movement of said pedal connecting rod will cause rotation of said pedal crank and said shaft to which it is mounted, and an adjustable stop means cooperating with said pedal crank to determine the amount of rotation imparted to said crank and said shaft on which it is mounted by said pedal and pedal connecting rod.

11. The structure claimed in claim 4 including an L-shaped element mounted on at least one of said pull rod mounting shafts with one leg of said L-shaped member depending downwardly and one leg thereof extending substantially horizontally toward the tail end of said instrument a knee pedal being pivotally mounted on said downwardly depending leg and being shiftable thereon between a downwardly depending position and a folded substantially horizontal position extending toward the tail end of said instrument, whereby when said knee pedal is in its downwardly depending position and is shifted toward the head end of said instrument by the operator's knee it will cause said rotation of said shaft to which said knee pedal is attached by its L-shaped member, and an adjustable stop means cooperating with said downwardly depending leg of said L-shaped member to determine the amount by which said last mentioned shaft is rotated by said knee pedal.

12. The structure claimed in claim 4 including an L-shaped element mounted on a first one of said shafts with one leg of said L-shaped member depending downwardly and one leg thereof extending substantially horizontally toward the head end of said instrument and toward a second adjacent one of said shafts having at least one of said pull rod cranks mounted thereon, a knee pedal being pivotally mounted on said downwardly depending leg and being shiftable thereon between a downwardly depending position and a folded substantially horizontal position extending toward the head end of said instrument, said second shaft having a pedal crank mounted thereon so as to normally extend substantially horizontally toward said first shaft and the tail end of said instrument, said horizontal leg of said L-shaped element having a slot therein, said pedal crank having a laterally extending pin engaged in said slot of said horizontal leg of said L-shaped member whereby when said knee pedal is in its downwardly depending position and is shifted toward the tail end of said instrument by the operator's knee the interaction of said horizontal leg of said L-shaped element and said pedal crank will rotate said second shaft and said at least one pull rod crank mounted thereon, and an adjustable stop means cooperating with said downwardly depending leg of said L-shaped member to determine the amount of which said second shaft is rotated by said knee pedal.

13. The structure claimed in claim 1 including fastening means joining said lower end of said lowering bar to said lower end of said raising bar whereby a pulling force toward the head end of said instrument applied to a pull rod attached to either of said raising and lowering bars will urge said lowering bar foot against said string finger leg to pivot said string finger to said pitch-raising position.

* * * * *